US009773442B2

(12) United States Patent
Lee et al.

(10) Patent No.: US 9,773,442 B2
(45) Date of Patent: Sep. 26, 2017

(54) DISPLAY PANEL HAVING A NON-QUADRILATERAL SHAPE

(71) Applicant: Samsung Display Co., Ltd., Yongin (KR)

(72) Inventors: Gi Chang Lee, Hwaseong-si (KR); In Soo Wang, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/599,952

(22) Filed: Jan. 19, 2015

(65) Prior Publication Data

US 2016/0055779 A1 Feb. 25, 2016

(30) Foreign Application Priority Data

Aug. 25, 2014 (KR) ..... 10-2014-0110968

(51) Int. Cl.
*G09G 3/20* (2006.01)

(52) U.S. Cl.
CPC ..... *G09G 3/20* (2013.01); *G09G 2300/0426* (2013.01); *G09G 2320/0223* (2013.01)

(58) Field of Classification Search
CPC ..... G09G 3/20; G09G 2300/0421; G09G 2300/0426; G09G 2320/0223
USPC ..... 345/55, 103
See application file for complete search history.

(56) References Cited

U.S. PATENT DOCUMENTS

| | | | | |
|---|---|---|---|---|
| D659,589 | S | 5/2012 | Dunn | |
| 8,952,877 | B2 * | 2/2015 | Kim | G02F 1/136286 345/204 |
| 2006/0164350 | A1 * | 7/2006 | Kim | G09G 3/3614 345/87 |
| 2008/0018583 | A1 * | 1/2008 | Knapp | G02F 1/1333 345/99 |
| 2009/0102758 | A1 * | 4/2009 | Anzai | G09G 3/3225 345/76 |

FOREIGN PATENT DOCUMENTS

| | | |
|---|---|---|
| KR | 10-2009-0059661 | 6/2009 |
| KR | 10-2011-0008939 | 1/2011 |

* cited by examiner

*Primary Examiner* — Stephen Sherman
(74) *Attorney, Agent, or Firm* — H.C. Park & Associates, PLC

(57) ABSTRACT

A display device having a display area including a plurality of pixels and a non-quadrilateral shape, a first gate line in parallel with a first side of a virtual quadrilateral inscribed in the display area, a second gate line in parallel with a second side perpendicular to the first side of the virtual quadrilateral, a first data line in parallel with the first gate line; and a second data line in parallel with the second gate line.

11 Claims, 11 Drawing Sheets

D1: d1, ··· d80, ··· d160

S1: s1, ··· s80, ··· s160

D2: d161 ··· d240, ··· d320

S2: s161, ··· s240, ··· s320

DISPLAY PANEL HAVING A NON-QUADRILATERAL SHAPE

CROSS-REFERENCE TO RELATED APPLICATION

This application claims priority from and the benefit of Korean Patent Application No. 10-2014-0110968, filed on Aug. 25, 2014, which is hereby incorporated by reference for all purposes as if fully set forth herein.

BACKGROUND

Field

Exemplary embodiments relate to a display panel, and more particularly, to a non-rectangular display panel.

Discussion of the Background

As portable devices (such as notebook computers, mobile phones, and portable media players (PMPs)) as well as devices for homes (such as TVs and monitors) become lighter and thinner, various flat panel displays are being widely used. There are various types of flat panel displays, including liquid crystal displays (LCDs), organic light-emitting displays, and electrophoretic displays. Generally, flat panel displays are rectangular. However, display panels having various shapes such as circular, oval, and polygonal shapes are being developed.

A rectangular display panel may include a plurality of pixels defined by scan lines extending in parallel with a side of the rectangular display panel, and data lines extending in parallel with the other side perpendicular to the above-mentioned side of the rectangular display panel. Here, scan lines crossing a central portion of the rectangular display panel may have substantially the same length as scan lines crossing an edge portion of the rectangular display panel, and the same may be true for the data lines. Therefore, the data lines and the scan lines may have substantially the same panel load (such as resistive-capacitive (RC) delay), thus not causing a luminance difference.

However, if a conventional structure for scan lines and data lines is applied to the nonrectangular display panel, scan lines located in the central portion of the display panel may be different in length from scan lines located in the edge portion of the display panel, and the same may be true for the data lines. That is, the data lines and the scan lines may have different panel loads (such as RC delay) due to the difference in line length. Accordingly, this may cause a luminance difference, thereby degrading display quality.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a non-rectangular display panel which prevents a luminance difference by minimizing a difference in panel load between lines.

Additional aspects will be set forth in the detailed description which follows, and, in part, will be apparent from the disclosure, or may be learned by practice of the inventive concept.

An exemplary embodiment of the present invention discloses a display device including a display area including a plurality of pixels and having a non-quadrilateral shape, a first gate line in parallel with a side of a virtual quadrilateral inscribed in the display area, a second gate line in parallel with the other side perpendicular to the above-mentioned side of the virtual quadrilateral, a first data line in parallel with the first gate line, and a second data line in parallel with the second gate line.

An exemplary embodiment also discloses a display device including a display area including a plurality of pixels and having a non-quadrilateral shape, a first gate line forming a first angle with a virtual line crossing a center of the display area, a second gate line symmetrical to the first gate line with respect to the virtual line, a first data line in parallel with the first gate line, and a second data line in parallel with the second gate line.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
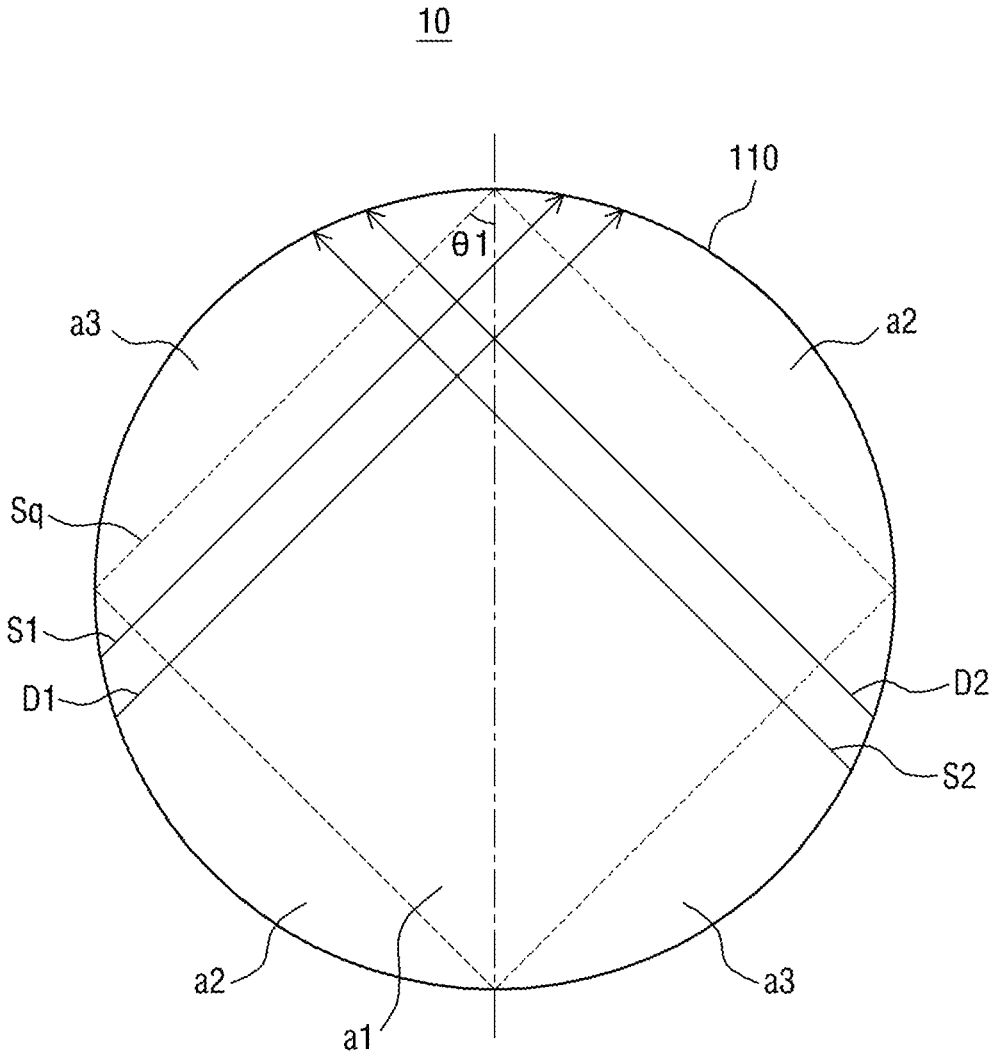
FIG. 1 is a plan view of a display panel according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
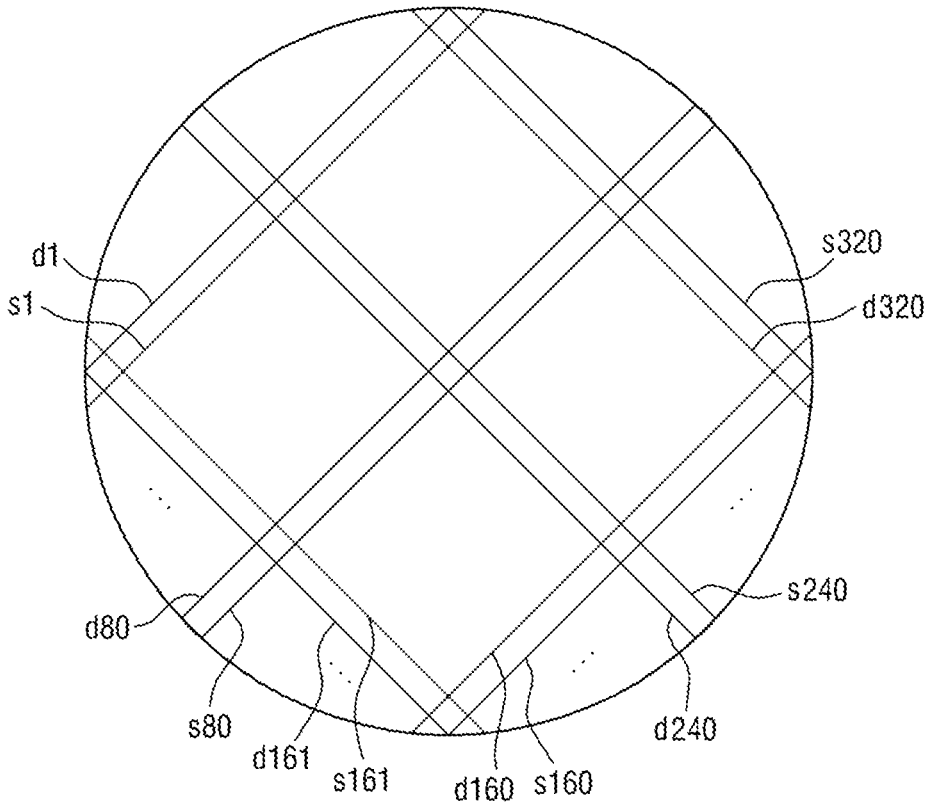
FIG. 2 is a schematic diagram of gate lines and data lines according to an exemplary embodiment of the present invention.

Referring to FIGS. 1 and 2, a display panel 10 includes a display area 110, a first gate line S1, a second gate line S2, a first data line D1, and a second data line D2.

The display panel 10 displays an image. The display panel 10 may be a liquid crystal display (LCD) panel, an electrophoretic display panel, an organic light-emitting diode (OLED) panel, a light-emitting diode (LED) panel, an inorganic electroluminescent (EL) display panel, a field emission display (FED) panel, a surface-conduction electron-emitter display (SED) panel, a plasma display panel (PDP), or a cathode ray tube (CRT) display panel.

The display panel 10 may be the non-rectangular display area 110. The display area 110 may have, but is not limited to, a circular shape. The configuration of the display area 110 (which will be described later) can be applied not only to circular display areas but also to display areas of other shapes.

The display area 110 may include a plurality of pixels. The pixels may be arranged in a matrix. Each of the pixels may be turned on by a gate line connected thereto and, when turned on, may receive a data voltage from a data line connected thereto. Each of the pixels may display an image corresponding to a data voltage. That is, the pixels may be defined by gate lines and data lines on the display area 110.

The first gate line S1 may extend to form a first angle θ1 with a virtual line that crosses a center of the display area 110. The second gate line S2 may be symmetrical to the first gate line S1 with respect to the virtual line. That is, the second gate line S2 may also form the first angle θ1 with the virtual line in a direction symmetrical to the first gate line S1. In other words, the display panel 10 may include the first gate line S1 and the second gate line S2 extending symmetrically to each other. The first gate line S1 and the second gate line S2 may provide scan signals in different directions. The first angle θ1 may be 45 degrees, and the first gate line S1 and the second gate line S2 may intersect each other. However, the first angle θ1 formed by the first gate line S1 and the virtual line is not limited to the above example.

A virtual quadrilateral may be inscribed in the display area 110, and the virtual line may cross corners of the virtual quadrilateral inscribed in the display area 110 and the center of the display area 110. Here, the virtual quadrilateral may be a square, and the display area 110 may be circular.

The first gate line S1 may extend in parallel with a side of the inscribed square, and the second gate line S2 may extend in parallel with the other side of the square. That is, the first gate line S1 and the second gate line S2 may intersect each other on the display area 110.

The first data line D1 may be parallel to the first gate line S1, and the second data line D2 may be parallel to the second gate line S2. That is, the first data line D1 and the second data line D2 may also intersect each other on the display area 110.

The virtual square inscribed in the display area 110 may be an area defined by the first and second gate lines S1 and S2 intersecting each other, and the first and second data lines D1 and D2 intersecting each other. That is, the display area 110 may include a first area a1 inside the virtual square and a second area a2 and a third area a3 outside the virtual square. The first area a1 may be an area in which all of the first and second gate lines S1 and S2, and the first and second data lines D1 and D2 pass. The second area a2 may be an area in which only the first gate line S1 and the first data line D1 pass, and the third area a3 may be an area that only the second gate line S2 and the second data line D2 pass. The first and second gate lines S1 and S2 may be formed on a different layer from the first and second data lines D1 and D2 in order to prevent a short-circuit resulting from electrical 1111 contact between them.

The first gate line S1 may include $1^{st}$ through $160^{th}$ scan lines s1 through s160, and the second gate line S2 may include $161^{st}$ through $320^{th}$ scan lines s161 through s320. Each scan line of the first gate line S1 may intersect each scan line of the second gate line S2. In addition, the first data line D1 may include $1^{st}$ through $160^{th}$ source lines d1 through d160, and the second data line D2 may include $161^{st}$ through $320^{th}$ source lines d161 through d320. Each source line of the first data line D1 may intersect each source line of the second data line D2. Here, the number of scan lines and the number of source lines are not limited to the example of FIG. 2.

Among the scan lines of the first gate line S1, the $1^{st}$ scan line s1 and the $160^{th}$ scan line s160 may be the shortest scan lines, and the $80^{th}$ scan line s80 may be the longest scan line. The $1^{st}$ scan line s1 and the $160^{th}$ scan line s160 may pass the first area a1 only, and the $80^{th}$ scan line s80 may pass both the first area a1 and the second area a2. Here, a difference in length between the $1^{st}$ scan line s1 (i.e., the shortest scan line) and the $80^{th}$ scan line s80 (i.e., the longest scan line) may be far less than that in a conventional quadrilateral display device. Therefore, a difference in panel load (such as resistive-capacitive (RC) delay) between the $1^{st}$ scan line s1 and the $80^{th}$ scan line s80 may also be small, which, in turn, can minimize a reduction in display quality resulting from a luminance difference. The same effect is true for the first data line D1, the second gate line S2, and the second data line D2. Because the difference in RC delay between the shortest line and the longest line is minimized, a reduction in display quality as a result of the luminance difference can be minimized. That is, the display panel 10 according to an exemplary embodiment can provide improved display quality.

The pixel structure of the display area 110 will now be described in greater detail with reference to FIGS. 3 through 6.

Figure 3:
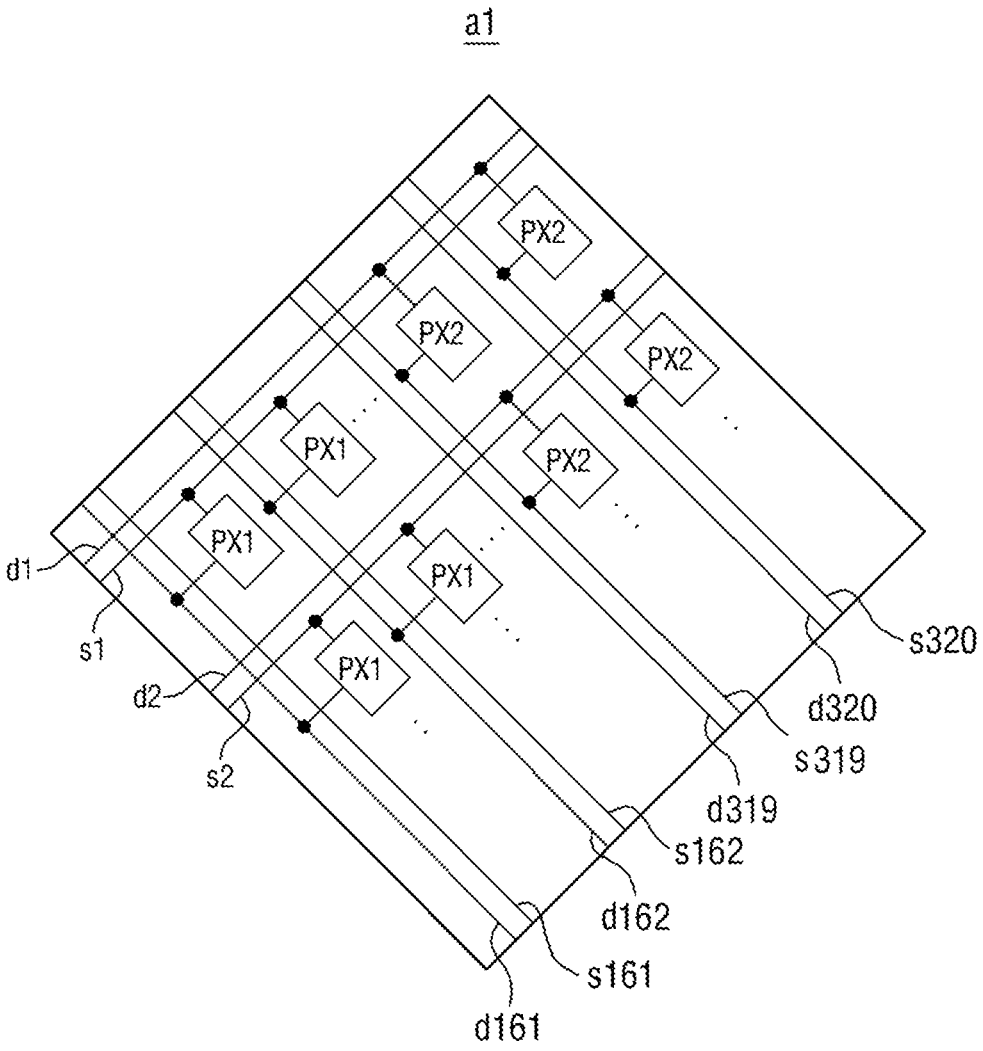
FIG. 3 is an enlarged plan view of a first area a1 illustrated in FIG. 1.
Figure 4:
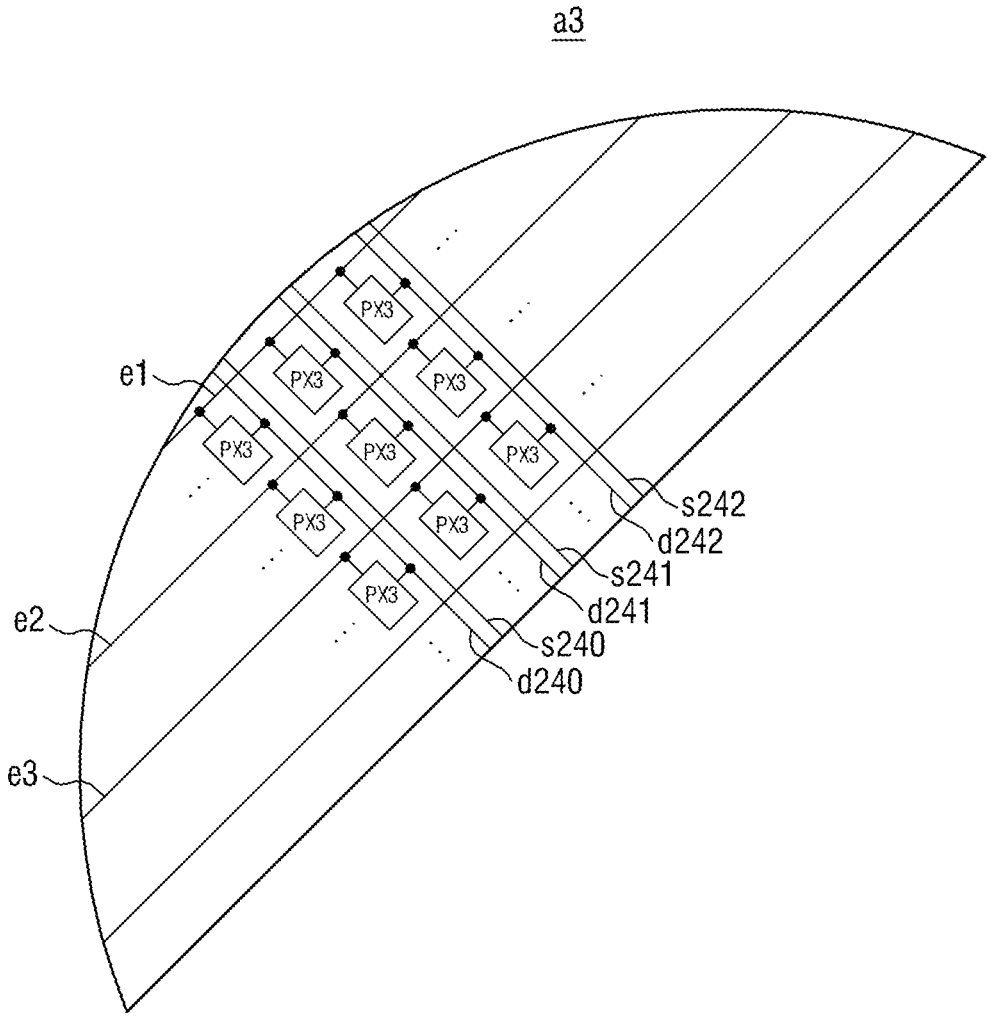
FIG. 4 is an enlarged plan view of a third area a3 illustrated in FIG. 1.
Figure 5:
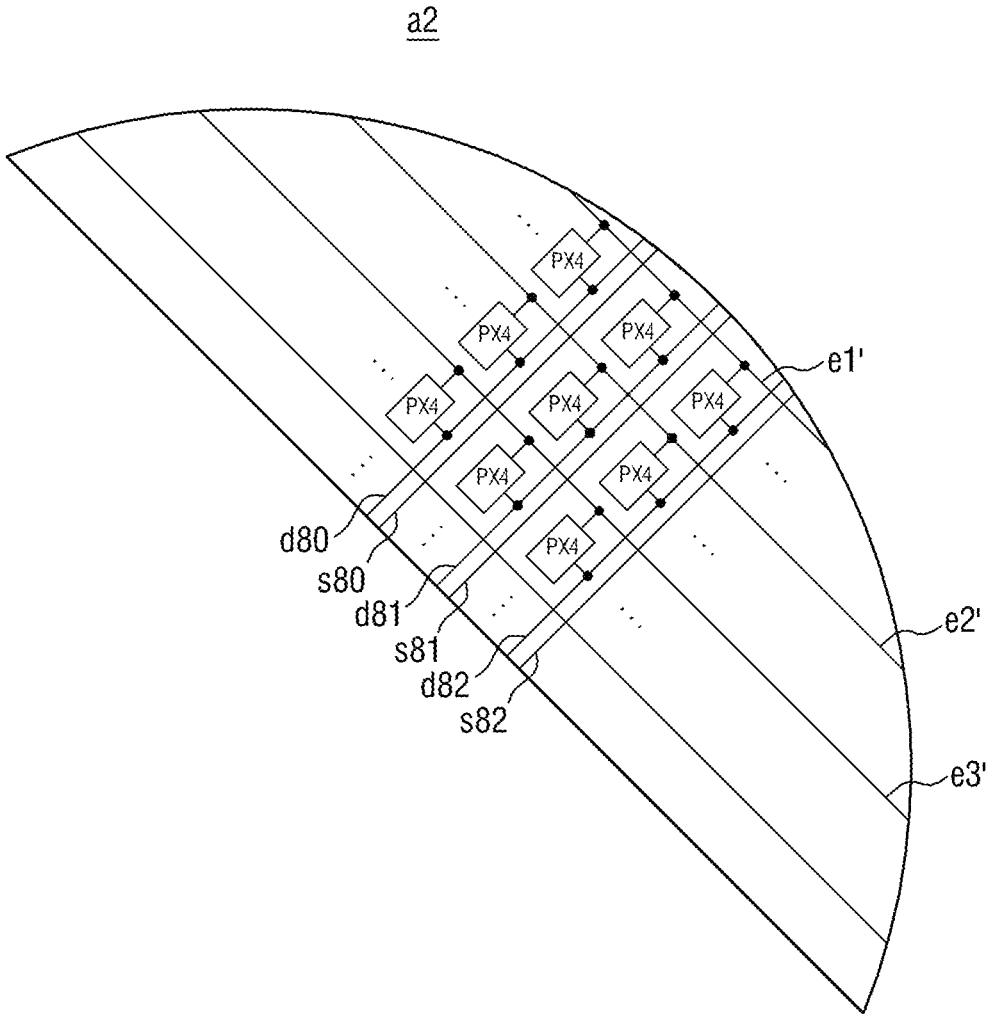
FIG. 5 is an enlarged plan view of a second area a2 illustrated in FIG. 1.
Figure 6:
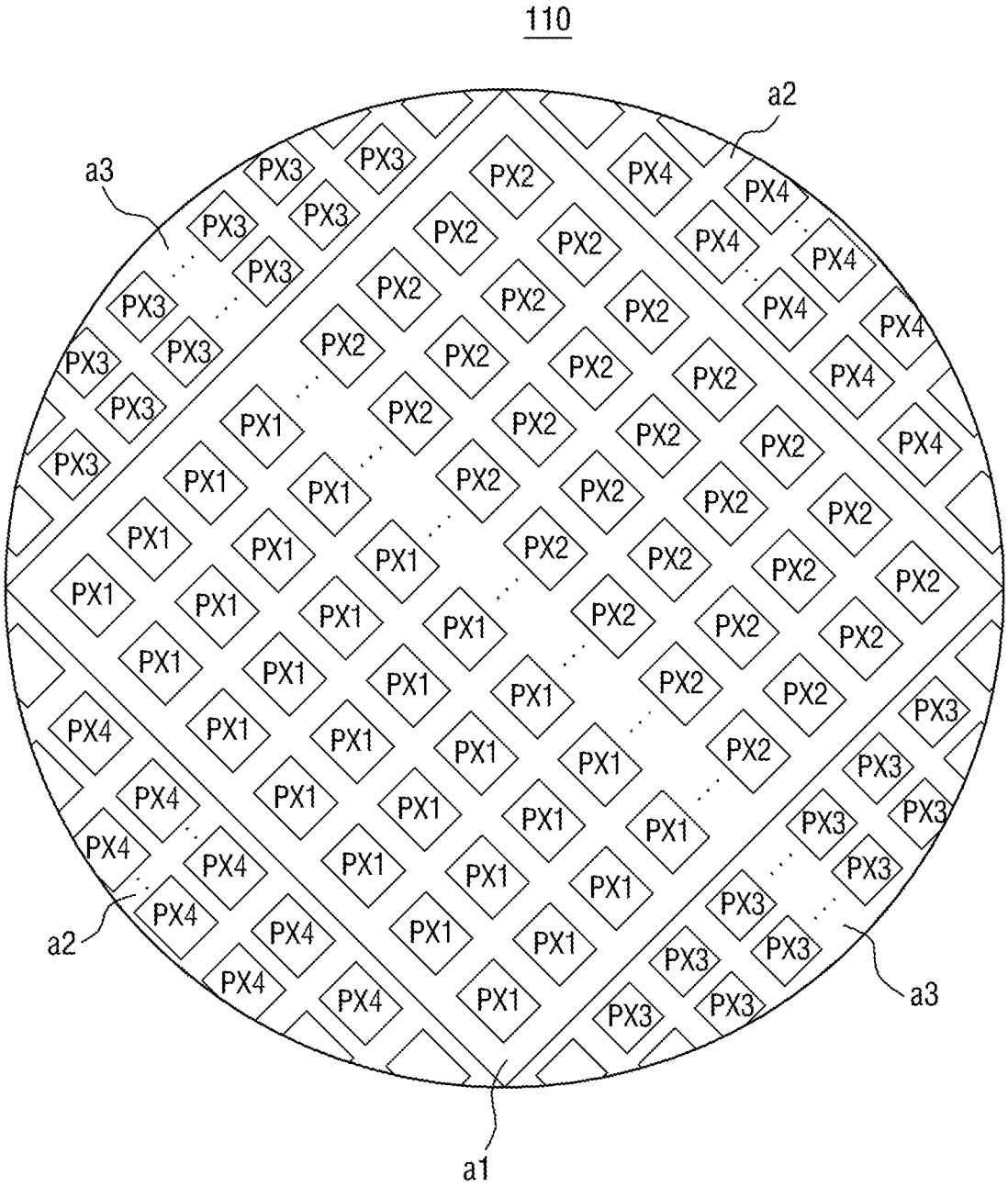
FIG. 6 is a schematic diagram illustrating the pixel structure of a display area according to an exemplary embodiment of the present invention.

FIG. 3 is an enlarged plan view of the first area a1 illustrated in FIG. 1. FIG. 4 is an enlarged plan view of the third area a3 illustrated in FIG. 1. FIG. 5 is an enlarged plan view of the second area a2 illustrated in FIG. 1. FIG. 6 is a schematic diagram illustrating the pixel structure of the display panel 10 according to the embodiment of FIG. 1.

Referring to FIGS. 3 through 6, the pixels of the display area 110 may be defined as a first pixel PX1, a second pixel PX2, a fourth pixel PX3, and a third pixel PX4.

The first pixel PX1 may be turned on by a scan signal provided by the first gate line S1 to receive a data voltage provided by the second data line D2. The second pixel PX2 may be turned on by a scan signal provided by the second gate line S2 to receive a data voltage provided by the first data line D1. The fourth pixel PX3 may be turned on by a scan signal provided by the second gate line S2 to receive a data voltage provided by the second data line D2. The fourth pixel PX4 may be turned on by a scan signal provided by the first gate line S1 to receive a data voltage provided by the first data line D1.

The first area a1 of the display area 110 according to the present exemplary embodiment may include a plurality of first pixels PX1 and a plurality of second pixels PX2, the second area a2 may include a plurality of third pixels PX4, and the third area a3 may include a plurality of fourth pixels PX3.

Here, the first area a1 may be divided into a first pixel block composed of the first pixels PX1 and a second pixel block composed of the second pixels PX2. The first pixels PX1 included in the first pixel block may be connected to scan lines included in the first gate line S1. That is, as illustrated in FIG. 3, the $1^{st}$ through $160^{th}$ scan lines s1 through s160 may be connected to the first pixels PX1, and the first pixels PX1 may be turned by scan signals received through the $1^{st}$ through $160^{th}$ scan lines s1 through s160. In addition, the first pixels PX1 included in the first pixel block may respectively be connected to the $161^{st}$ through $240^{th}$ source lines d161 through d240 among source lines included in the second data line D2 and receive data voltages from the $161^{st}$ through $240^{th}$ source lines d161 through d240.

The second pixels PX2 included in the second pixel block may be connected to scan lines of the second gate line S2 and receive data voltages from the first data line D1. That is, as illustrated in FIG. 3, the second pixels PX2 may respectively be connected to the $241^{st}$ through $320^{th}$ scan lines s241 through s320 which correspond to half of the second gate line S2, and may be turned on by scan signals received through the $241^{st}$ through $320^{th}$ scan lines s241 through s320. In addition, the second pixels PX2 included in the second pixel block may respectively be connected to the $1^{st}$ through $160^{th}$ source lines d1 through d160 of the first data line D1 and receive data voltages from the $1^{st}$ through $160^{th}$ source lines d1 through d160.

The third area a3 may be passed by the second gate line S2 and the second data line D2 only. The third area a3 may be composed of the fourth pixels PX3 which are turned on by scan signals provided by the second gate line S2 to receive data voltages from the second data line S2. The third area a3 may be formed on left and right sides of the first area a1. Since the second gate line S2 and the second data line D2 extend in parallel with each other, the third area a3 may further include a plurality of contact lines e1, e2, e3, . . . for controlling the fourth pixels PX3. The contact lines e1, e2, e3, . . . may be arranged in a direction perpendicular to a direction in which the second gate line S2 extends. That is, the fourth pixels PX3 of the third area a3 may be defined by the contact lines e1, e2, e3, . . . and the second data line S2, and each of the fourth pixels PX3 may be connected to a contact line and a source line. Each contact line may be connected one-to-one to each scan line. However, the present invention is not limited thereto. In some embodiments, each of the fourth pixels PX3 may be connected to a contact line and a scan line, and each contact line may be connected to each source line. A contact line may receive a scan signal from a connected scan line and provide the received scan signal to a connected fourth pixel PX3, thereby turning on the connected fourth pixel PX3. The turned-on fourth pixel PX3 may receive a data voltage from a connected source line.

The second area a2 may be passed by the first gate line S1 and the first data line D1 only. The second area a2 may be composed of the third pixels PX4 which are turned on by scan signals provided by the first gate line S1 and receive data voltages provided by the first data line S1. The second area a2 may be formed on or under the first area a1. Since the first gate line S1 and the first data line D1 extend in parallel with each other, the second area a2 may further include a plurality of contact lines e1', e2', e3', . . . for controlling the third pixels PX4. The contact lines e1', e2', e3', . . . may be arranged in a direction perpendicular to a direction in which the first gate line S1 extends. That is, the third pixels PX4 of the second area a2 may be defined by the contact lines e1', e2', e3', . . . and the first data line D1, and each of the third pixels PX4 may be connected to a contact line and a source line. Each contact line may be connected one-to-one to each scan line. However, the present invention is not limited thereto. In some embodiments, each of the third pixels PX4 may be connected to a contact line and a scan line, and each contact line may be connected to each source line. A contact line may receive a scan signal from a connected scan line and provide the received scan signal to a connected third pixel PX4, thereby turning on the connected third pixel PX4. The turned-on third pixel PX4 may receive a data voltage from a connected source line.

As described above, the display device according to the present exemplary embodiment includes data lines and gate lines intersecting each other in a non-quadrilateral display area. Therefore, it is possible to minimize a reduction in display quality due to a luminance difference resulting from a difference in line length.

Display panels according to other exemplary embodiments of the present invention will now be described.

Figure 7:
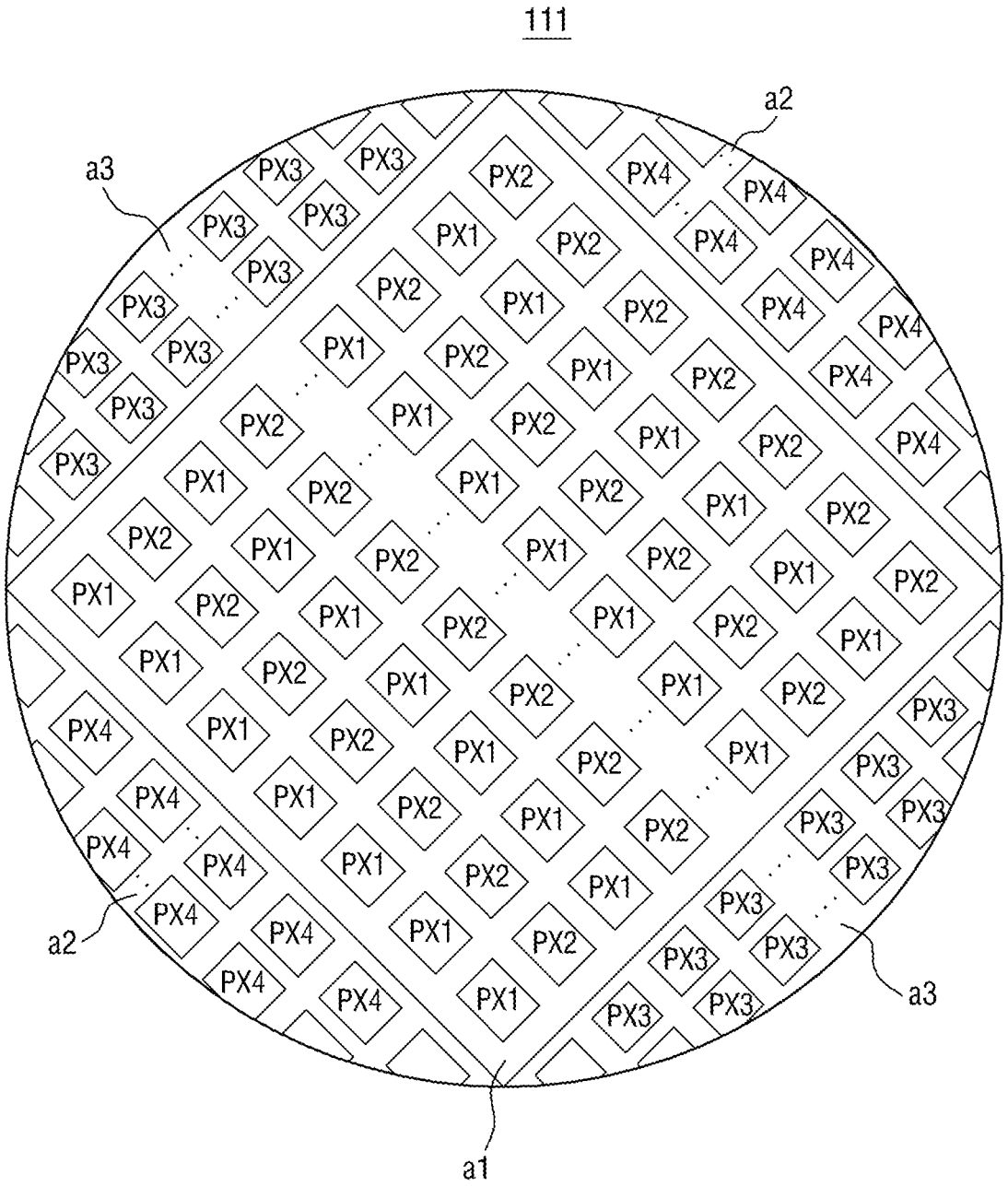
FIG. 7 is a schematic diagram illustrating the pixel structure of a display area according to another exemplary embodiment of the present invention.
Figure 8:
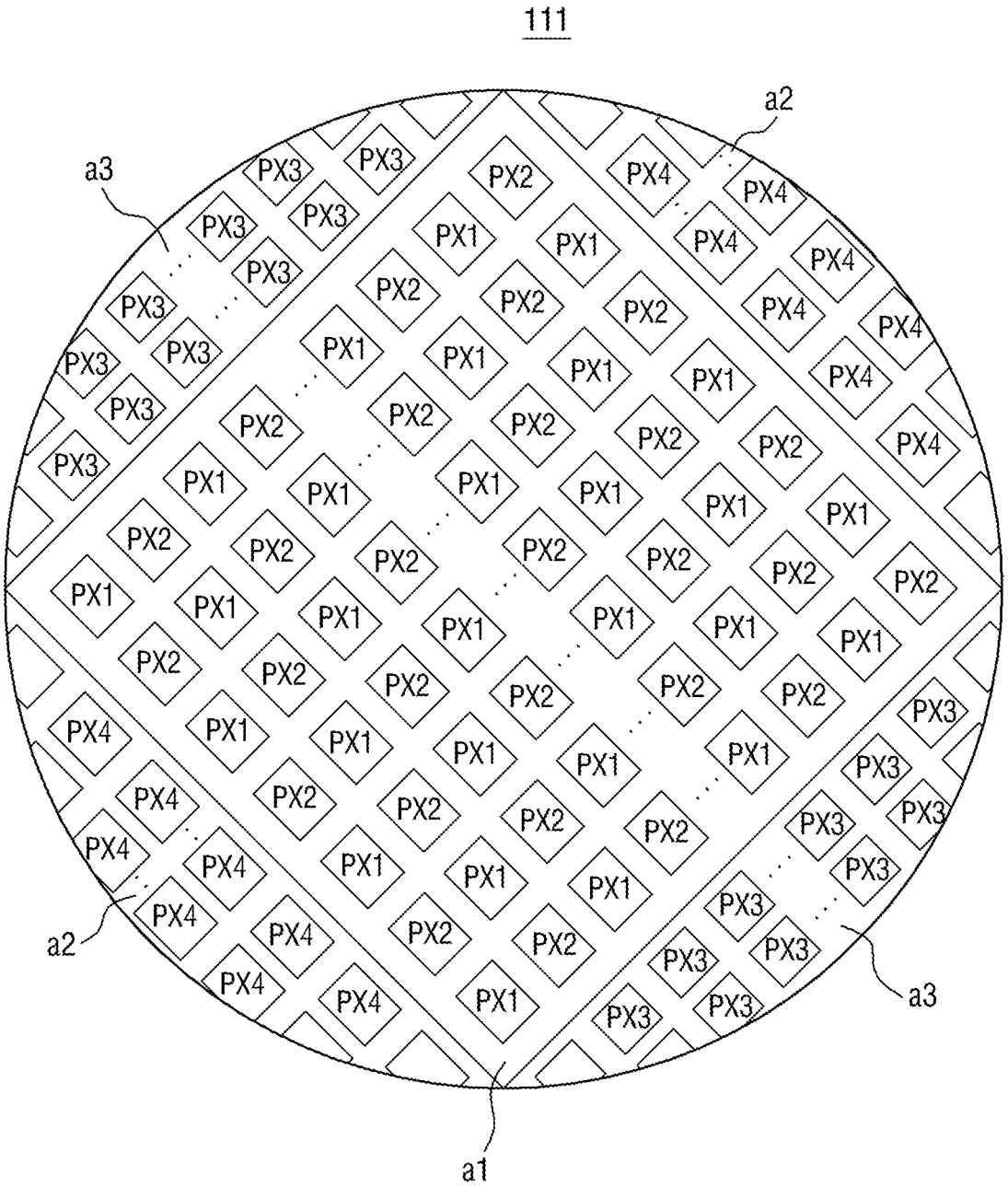
FIG. 8 is a schematic diagram illustrating the pixel structure of a display area according to another exemplary embodiment of the present invention.
Figure 9:
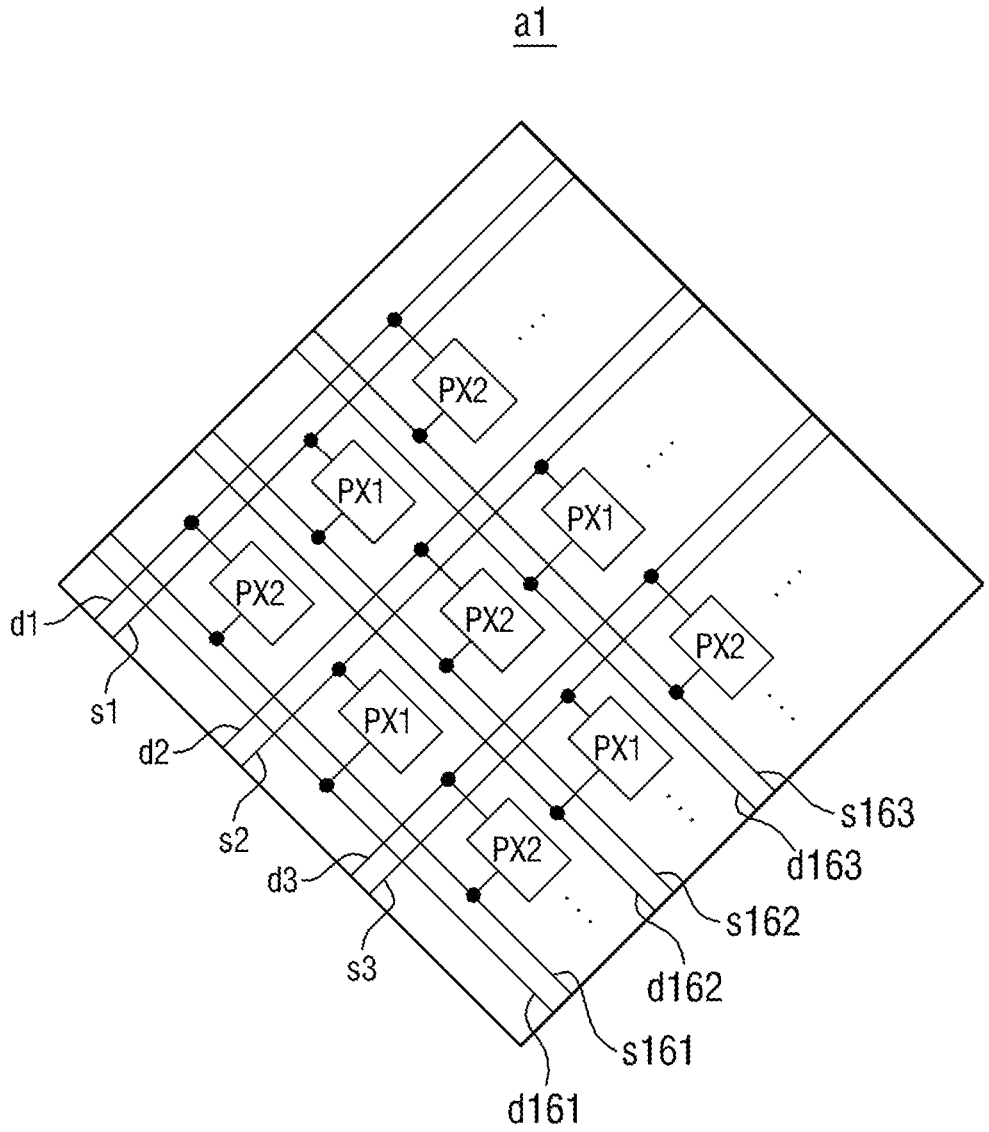
FIG. 9 is a plan view of a first area a1 illustrated in FIG. 8.
Figure 10:
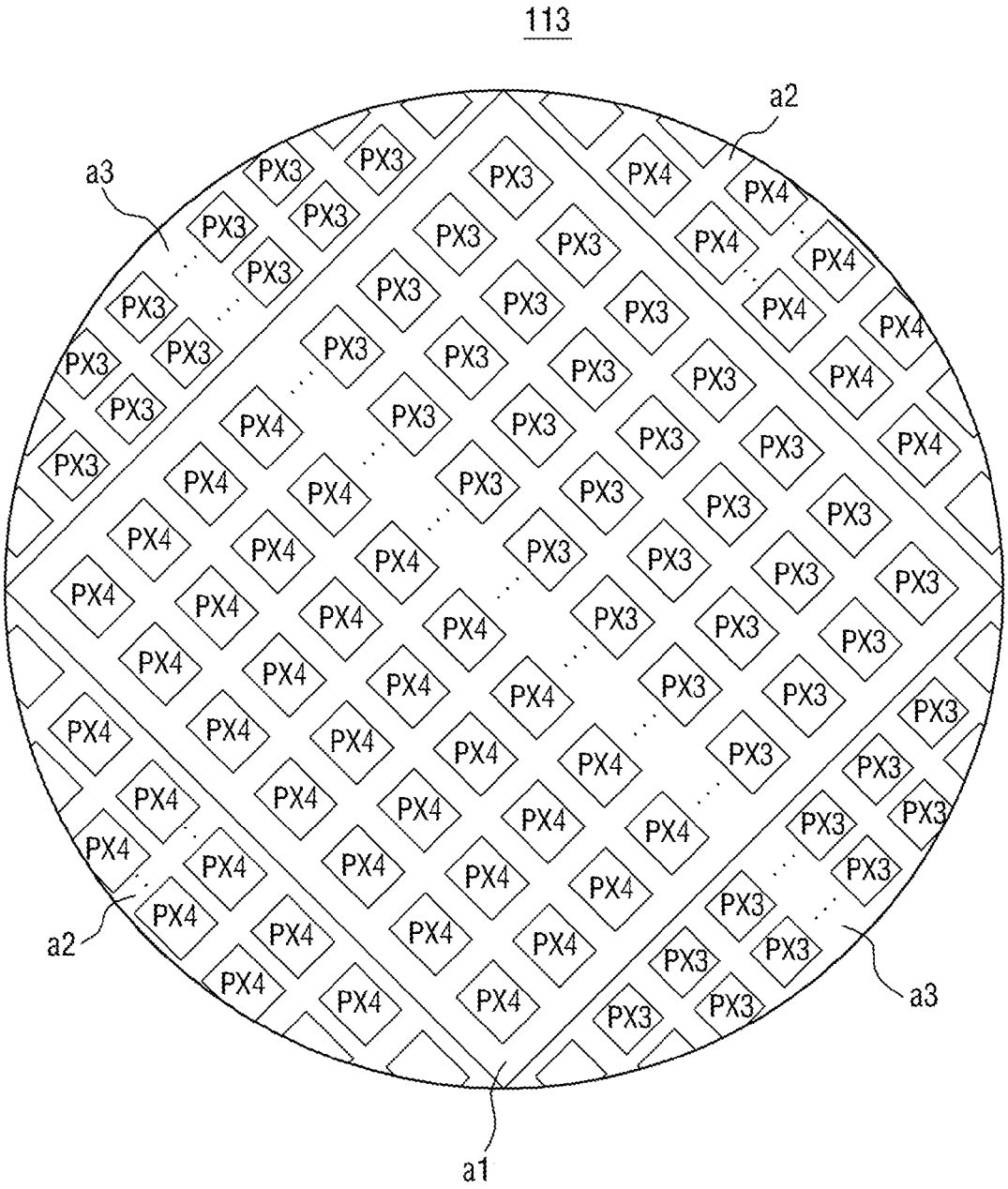
FIG. 10 is a schematic diagram illustrating the pixel structure of a display area according to another exemplary embodiment of the present invention.
Figure 11:
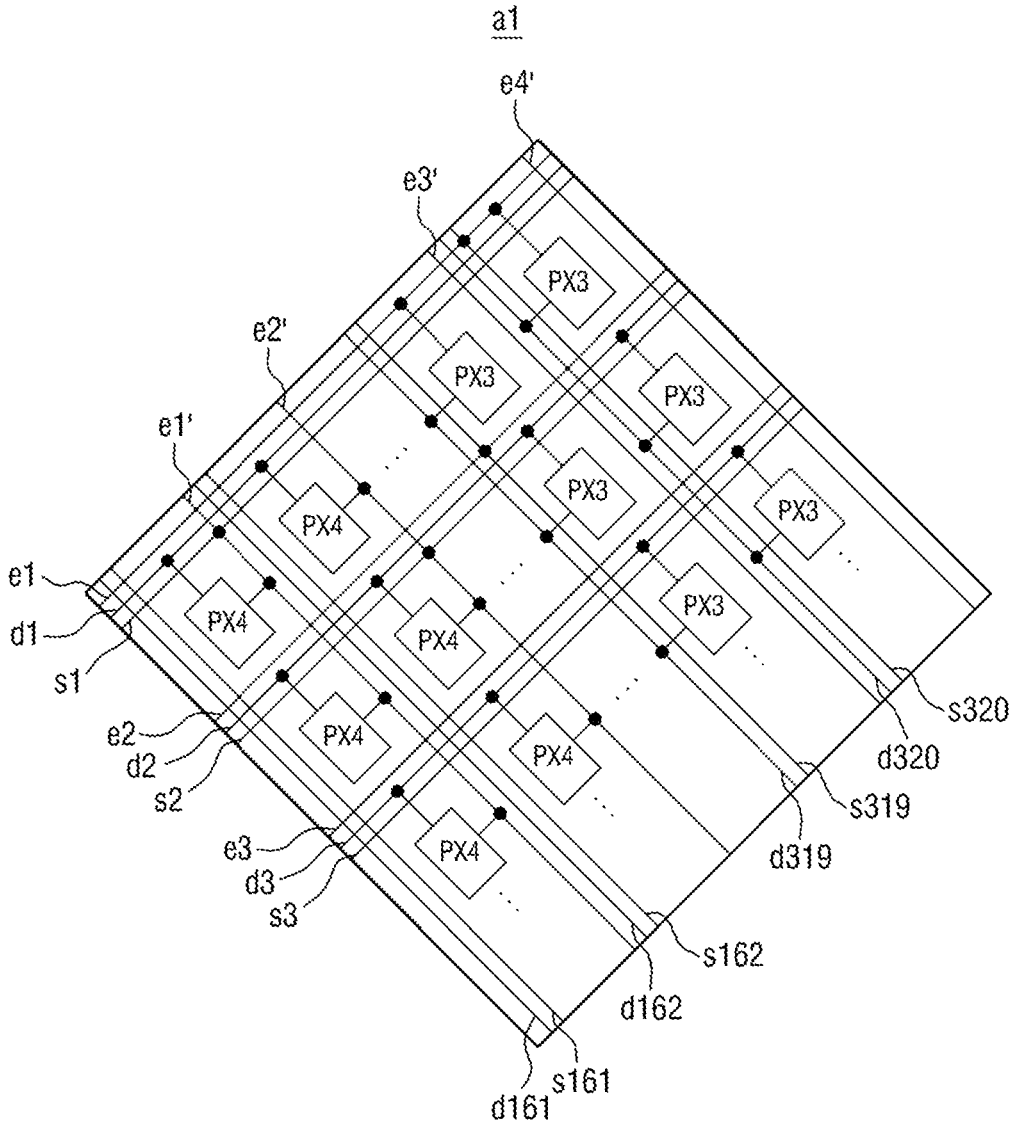
FIG. 11 is an enlarged plan view of a first area a1 illustrated in FIG. 10.

FIG. 7 is a schematic diagram illustrating the pixel structure of a display area according to another exemplary embodiment of the present invention. FIG. 8 is a schematic diagram illustrating the pixel structure of a display area according to another exemplary embodiment of the present invention. FIG. 9 is a plan view of a first area a1 illustrated in FIG. 8. FIG. 10 is a schematic diagram illustrating the pixel structure of a display area according to another exemplary embodiment of the present invention. FIG. 11 is an enlarged plan view of a first area a1 illustrated in FIG. 10.

Referring to FIGS. 7 through 11, a first area a1 of the display area according to the present exemplary embodiment includes a first pixel block composed of first pixels PX1 and a second pixel block composed of second pixels PX2. Here, the first pixel block and the second pixel block may be alternately provided. That is, the first area a1 need not be divided into an area composed of the first pixels PX1 and an area composed of the second pixels PX2. Instead, the first pixel block composed of the first pixels PX1 and the second pixel block composed of the second pixels PX2 may be arranged alternately.

Referring to FIG. 8, the first area a1 of the display area according to the present exemplary embodiment may include first pixels PX1 and second pixels PX2 arranged alternately. The first pixels PX1 and the second pixels PX2 may be arranged in a dot-inversion manner, that is, may be arranged alternately in a row direction and a column direction. That is, as illustrated in FIG. 9, a second gate line S2 may be connected only to the second pixels PX2 among the first and second pixels PX1 and PX2 arranged along a direction in which the second gate line S2 extends and may provide a scan signal only to the second pixels PX2. In addition, a first gate line S1 may be connected only to the first pixels PX1 among the first and second pixels PX1 and PX2 arranged along a direction in which the first gate line S1 extends.

Further, the first area a1 may not be composed of the first pixels PX1 and the second pixels PX2. That is, as illustrated in FIGS. 10 and 11, the first area a1 may be composed of third pixels PX4 which are turned on by scan signals provided by a first gate line S1 and receive data voltages provided by a first data line D1 and fourth pixels PX3 which are turned on by scan signals provided by a second gate line S2 and receive data voltages provided by a second data line D2.

Here, the first area a1 may further include a contact line which defines each pixel and is connected to each pixel. That is, contact lines e1, e2, e3, . . . may be in parallel with the first gate line S1, and contact lines e1', e2', e3', . . . may be in parallel with the second gate line S2.

Other elements of the display panels are substantially identical to those of the display panel 10 of FIGS. 1 and 6 identified by the same names or reference characters, and thus a detailed description thereof is omitted.

The disclosed exemplary embodiments of the present invention make it possible to minimize a luminance difference caused by a difference in length between lines of a non-rectangular display panel.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display device comprising:

a display area comprising a plurality of pixels and having a non-quadrilateral shape;

a first gate line in parallel with a first side of a virtual quadrilateral inscribed in the display area;

a second gate line in parallel with a second side perpendicular to the first side of the virtual quadrilateral;

a first data line constantly in parallel with the first gate line in the display area; and a second data line constantly in parallel with the second gate line in the display area.

2. The display device of claim 1, wherein the display area comprises:

a first area through which all of the first gate line, the second gate line, the first data line, and the second data line pass;

a second area through which only the first gate line and the first data line pass; and a third area through which only the second gate line and the second data line pass.

3. The display device of claim 2, wherein:

the second area comprises fourth pixels configured to be turned on by scan signals provided by the first gate line to receive data voltages provided by the first data line; and the third area comprises third pixels configured to be turned on by scan signals provided by the second gate line to receive data voltages provided by the second data line.

4. The display device of claim 3, wherein:

the second area comprises a contact line intersecting the first gate line; and the third area comprises a contact line intersecting the second gate line.

5. The display device of claim 2, wherein the first area comprises:

fourth pixels configured to be turned on by scan signals provided by the first gate line to receive data voltages provided by the first data line: and third pixels configured to be turned on by scan signals provided by the second gate line to receive data voltages provided by the second data line.

6. The display device of claim 1, wherein the display area has a circular shape.

7. The display device of claim 1, wherein the virtual quadrilateral inscribed in the display area is a square.

8. A display device comprising:

a display area comprising a plurality of pixels and having a non-quadrilateral shape;

a first gate line in parallel with a first side of a virtual quadrilateral inscribed in the display area;

a second gate line in parallel with a second side perpendicular to the first side of the virtual quadrilateral;

a first data line in parallel with the first gate line; and a second data line in parallel with the second gate line, wherein:

the display area further comprises:

a first area through which all of the first gate line, the second gate line, the first data line, and the second data line pass;

a second area through which only the first gate line and the first data line pass; and a third area through which only the second gate line and the second data line pass; and the first area comprises:

first pixels configured to be turned on by scan signals provided by the first gate line to receive data voltages provided by the second data line; and second pixels configured to be turned on by scan signals provided by the second gate line to receive data voltages provided by the first data line.

9. The display device of claim 8, wherein the first area is divided into a first pixel block comprised of the first pixels and a second pixel block comprised of the second pixels.

10. The display device of claim 8, wherein:

the first area comprises a first pixel block comprising the first pixels and a second pixel block comprising the second pixels; and the first pixel block and the second pixel block are arranged alternately.

11. The display device of claim 8, wherein the first pixels and the second pixels are arranged alternately.

* * * * *